US008438020B2

(12) United States Patent
Satoh et al.

(10) Patent No.: US 8,438,020 B2
(45) **Date of Patent: *May 7, 2013**

(54) VECTOR QUANTIZATION APPARATUS, VECTOR DEQUANTIZATION APPARATUS, AND THE METHODS

(75) Inventors: Kaoru Satoh, Kanagawa (JP); Toshiyuki Morii, Kanagawa (JP); Hiroyuki Ehara, Kanagawa (JP)

(73) Assignee: Panasonic Corporation, Osaka (JP)

( * ) Notice: Subject to any disclaimer, the term of this patent is extended or adjusted under 35 U.S.C. 154(b) by 330 days.

This patent is subject to a terminal disclaimer.

(21) Appl. No.: 12/682,086

(22) PCT Filed: Oct. 10, 2008

(86) PCT No.: PCT/JP2008/002876

§ 371 (c)(1),
(2), (4) Date: Apr. 8, 2010

(87) PCT Pub. No.: WO2009/047911

PCT Pub. Date: Apr. 16, 2009

(65) Prior Publication Data

US 2010/0211398 A1 Aug. 19, 2010

(30) Foreign Application Priority Data

Oct. 12, 2007 (JP) ..... 2007-266922
Nov. 1, 2007 (JP) ..... 2007-285602

(51) Int. Cl.
*G10L 21/00* (2006.01)

(52) U.S. Cl.
USPC ..... 704/230; 704/221; 704/222

(58) Field of Classification Search ..... None
See application file for complete search history.

(56) References Cited

U.S. PATENT DOCUMENTS 7,809,557 B2 * 10/2010 Morii ..... 704/219
2004/0015346 A1 * 1/2004 Yasunaga et al. ..... 704/219

(Continued)

FOREIGN PATENT DOCUMENTS

EP 1791116 5/2007
EP 1818913 8/2007

(Continued)

OTHER PUBLICATIONS

U.S. Appl. No. 12/810,049 to Kaoru Satoh et al., filed Jun. 22, 2010.

(Continued)

*Primary Examiner* — Leonard Saint Cyr
(74) *Attorney, Agent, or Firm* — Greenblum & Bernstein, P.L.C.

(57) ABSTRACT

A vector quantizer which improves the accuracy of vector quantization in switching over a vector quantization codebook on a first stage depending on the type of feature having the correlation with a quantization target vector. In the vector quantizer, a classifier generates classification information representing a type of narrowband LSP vector having the correlation with wideband LSP (Line Spectral Pairs) of the plural types. A first codebook selects one sub-codebook corresponding to the classification information as a codebook used for the quantization of the first stage from plural sub-codebooks corresponding to each of the types of narrowband LSP vectors. A multiplier multiplies the quantization residual vector of the first stage inputted from an adder by a scaling factor corresponding to the classification information of plural scaling factors stored in a scaling factor determiner and outputs it to an adder as the quantization target of a second stage.

12 Claims, 5 Drawing Sheets

U.S. PATENT DOCUMENTS

| | | | | |
|---|---|---|---|---|
| 2004/0260545 | A1* | 12/2004 | Gao et al. | 704/222 |
| 2007/0255559 | A1* | 11/2007 | Gao et al. | 704/225 |
| 2008/0040107 | A1* | 2/2008 | Ramprashad | 704/230 |
| 2008/0059166 | A1 | 3/2008 | Ehara | |
| 2009/0292537 | A1* | 11/2009 | Ehara et al. | 704/230 |

FOREIGN PATENT DOCUMENTS

| | | |
|---|---|---|
| WO | 99/16050 | 4/1999 |
| WO | 2006/030865 | 3/2006 |
| WO | 2006/062202 | 6/2006 |
| WO | 2007/132750 | 11/2007 |
| WO | 2008/047795 | 4/2008 |

OTHER PUBLICATIONS

Allen Gersho, Robert M. Gray, "Vector Quantization and Information Compression," Corona Publishing Co. Ltd., pp. 524-531, along with an English language translation, Nov. 10, 1998.

Bhattacharya B et al., "Tree searched multi-stage vector quantization of LPC parameters for 4 kb/s speech coding," Proceedings of the International Conference on Acoustics, Speech and Signal Processing (ICASSP), IEEE, US, vol. 1, XP010058705, Mar. 23, 1992, pp. 105-108.

Search report from E.P.O., mail date is Jul. 19, 2012.

* cited by examiner

VECTOR QUANTIZATION APPARATUS, VECTOR DEQUANTIZATION APPARATUS, AND THE METHODS

TECHNICAL FIELD

The present invention relates to a vector quantization apparatus, vector dequantization apparatus and quantization and dequantization methods for performing vector quantization of LSP (Line Spectral Pairs) parameters. In particular, the present invention relates to a vector quantization apparatus, vector dequantization method and quantization and dequantization methods for performing vector quantization of LSP parameters used in a speech coding and decoding apparatus that transmits speech signals in the fields of a packet communication system represented by Internet communication, a mobile communication system, and so on.

BACKGROUND ART

In the field of digital wireless communication, packet communication represented by Internet communication and speech storage, speech signal coding and decoding techniques are essential for effective use of channel capacity and storage media for radio waves. In particular, a CELP (Code Excited Linear Prediction) speech coding and decoding technique is a mainstream technique A CELP speech coding apparatus encodes input speech based on pre-stored speech models. To be more specific, the CELP speech coding apparatus separates a digital speech signal into frames of regular time intervals, for example, frames of approximately 10 to 20 ms, performs a linear prediction analysis of a speech signal on a per frame basis, finds the linear prediction coefficients ("LPC's") and linear prediction residual vector, and encodes the linear prediction coefficients and linear prediction residual vector separately. As a method of encoding linear prediction coefficients, it is general to convert linear prediction coefficients into LSP parameters and encode these LSP parameters. Also, as a method of encoding LSP parameters, vector quantization is often performed for LSP parameters. Here, vector quantization is a method for selecting the most similar code vector to the quantization target vector from a codebook having a plurality of representative vectors (i.e. code vectors), and outputting the index (code) assigned to the selected code vector as a quantization result. In vector quantization, the codebook size is determined based on the amount of information that is available. For example, when vector quantization is performed using an amount of information of 8 bits, a codebook can be formed using 256 ($=2^8$) types of code vectors.

Also, to reduce the amount of information and the amount of calculations in vector quantization, various techniques such as multi-stage vector quantization (MSVQ) and split vector quantization (SVQ) are used (see Non-Patent Document 1). Here, multi-stage vector quantization is a method of performing vector quantization of a vector once and further performing vector quantization of the quantization error, and split vector quantization is a method of quantizing a plurality of split vectors acquired by splitting a vector.

Also, there is a technique of performing vector quantization suitable for LSP features and further improving LSP coding performance, by adequately switching the codebooks to use for vector quantization based on speech features that are correlated with the LSP's of the quantization target (e.g. information about the voiced characteristic, unvoiced characteristic and mode of speech). For example, in scalable coding, by utilizing the correlation between wideband LSP's (which are LSP's found from wideband signals) and narrowband LSP's (which are LSP's found from narrowband signals), classifying the narrowband LSP's by their features and switching codebooks in the first stage of multi-stage vector quantization based on the types of features of narrowband LSP's (hereinafter abbreviated to "types of narrowband LSP's"), wideband LSP's are subjected to vector quantization (see Patent Document 1).

Non-Patent Document 1: Allen Gersho, Robert M. Gray, translated by Yoshii and other three people, "Vector Quantization and Information Compression," Corona Publishing Co., Ltd, 10 Nov. 1998, pages 524 to 531

Patent Document 1: International publication No. 2006/030865 pamphlet

DISCLOSURE OF INVENTION

Problems to be Solved by the Invention

In multi-stage vector quantization disclosed in Patent Document 1, vector quantization in the first stage is performed using codebooks associated with the types of narrowband LSP's, and therefore the dispersion of quantization errors in vector quantization in the first stage varies between the types of narrowband LSP's. However, a single common codebook is used in a second or subsequent stage regardless of the types of narrowband LSP's, and therefore a problem arises that the accuracy of vector quantization in the second or subsequent stage is insufficient.

In view of the above points, it is therefore an object of the present invention to provide a vector quantization apparatus, vector dequantization apparatus and quantization and dequantization methods for improving the quantization accuracy in vector quantization in a second or subsequent stage, in multi-stage vector quantization in which the codebooks in the first stage are switched based on the types of features correlated with the quantization target vector.

Means for Solving the Problem

The vector quantization apparatus of the present invention employs a configuration having: a classifying section that generates classification information indicating a type of a feature correlated with a quantization target vector among a plurality of types; a selecting section that selects one first codebook associated with the classification information from a plurality of first codebooks associated with the plurality of types, respectively; a first quantization section that acquires a first code by quantizing the quantization target vector using a plurality of first code vectors forming the selected first codebook; a scaling factor codebook comprising scaling factors associated with the plurality of types, respectively; and a second quantization section that has a second codebook comprising a plurality of second code vectors and acquires a second code by quantizing a residual vector between one first code vector indicated by the first code and the quantization target vector, using the second code vectors and a scaling factor associated with the classification information.

The vector dequantization apparatus of the present invention employs a configuration having: a classifying section that generates classification information indicating a type of a feature correlated with a quantization target vector among a plurality of types; a demultiplexing section that demultiplexes a first code that is a quantization result of the quantization target vector in a first stage and a second code that is a quantization result of the quantization target vector in a second stage, from received encoded data; a selecting section that selects one first codebook associated with the classification information from a plurality of first codebooks associated with the plurality of types, respectively; a first dequantization section that selects one first code vector associated with the first code from the selected first codebook; a scaling factor codebook comprising scaling factors associated with the plurality of types, respectively; and a second dequantization section that selects one second code vector associated with the second code from a second codebook comprising a plurality of second code vectors, and acquires the quantization target vector using the one second code vector, a scaling factor associated with the classification information and the one first code vector.

The vector quantization method of the present invention includes the steps of: generating classification information indicating a type of a feature correlated with a quantization target vector among a plurality of types; selecting one first codebook associated with the classification information from a plurality of first codebooks associated with the plurality of types, respectively; acquiring a first code by quantizing the quantization target vector using a plurality of first code vectors forming the selected first codebook; and acquiring a second code by quantizing a residual vector between a first code vector associated with the first code and the quantization target vector, using a plurality of second code vectors forming a second codebook and a scaling factor associated with the classification information.

The vector dequantization method of the present invention includes the steps of: generating classification information indicating a type of a feature correlated with a quantization target vector among a plurality of types; demultiplexing a first code that is a quantization result of the quantization target vector in a first stage and a second code that is a quantization result of the quantization target vector in a second stage, from received encoded data; selecting one first codebook associated with the classification information from a plurality of first codebooks associated with the plurality of types, respectively; selecting one first code vector associated with the first code from the selected first codebook; and selecting one second code vector associated with the second code from a second codebook comprising a plurality of second code vectors, and generating the quantization target vector using the one second code vector, a scaling factor associated with the classification information and the one first code vector.

Advantageous Effect of the Invention

According to the present invention, in multi-stage vector quantization in which codebooks in the first stage are switched based on the types of feature correlated with the quantization target vector, by performing vector quantization in a second or subsequent stage using scaling factors associated with the above types, it is possible to improve the quantization accuracy in vector quantization in a second or subsequent stage.

BEST MODE FOR CARRYING OUT THE INVENTION

Embodiments of the present invention will be explained below in detail with reference to the accompanying drawings. Here, example cases will be explained using an LSP vector quantization apparatus, LSP vector dequantization apparatus and quantization and dequantization methods as the vector quantization apparatus, vector dequantization apparatus and quantization and dequantization methods according to the present invention.

Also, example cases will be explained with embodiments of the present invention, where wideband LSP's are used as the vector quantization target in a wideband LSP quantizer for scalable coding, and the codebooks used for quantization in the first stage are switched using the types of narrowband LSP's correlated with the vector quantization target. Also, it is equally possible to switch the codebooks used for quantization in the first stage using quantized narrowband LSP's (which are narrowband LSP's quantized in advance by a narrowband LSP quantizer (not shown)), instead of narrowband LSP's. Also, it is equally possible to convert quantized narrowband LSP's into a wideband format and switch the codebooks used for quantization in the first stage using the converted quantized narrowband LSP's.

Embodiment 1

Figure 1:
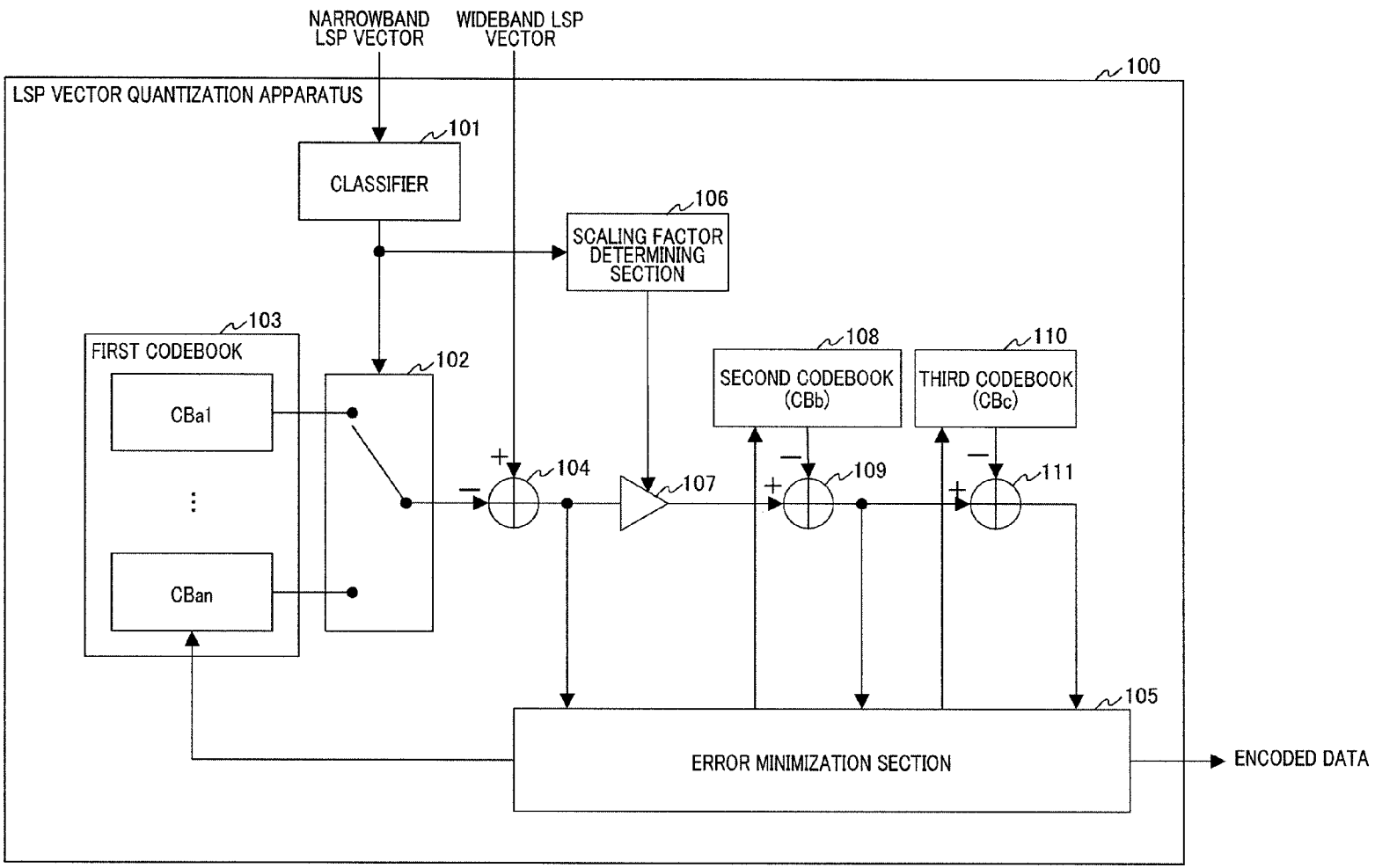
FIG. 1 is a block diagram showing main components of an LSP vector quantization apparatus according to Embodiment 1.

FIG. 1 is a block diagram showing main components of LSP vector quantization apparatus 100 according to Embodiment 1 of the present invention. Here, an example case will be explained where an input LSP vector is quantized by multi-stage vector quantization of three steps in LSP vector quantization apparatus 100.

In FIG. 1, LSP vector quantization apparatus 100 is provided with classifier 101, switch 102, first codebook 103, adder 104, error minimization section 105, scaling factor determining section 106, multiplier 107, second codebook 108, adder 109, third codebook 110 and adder 111.

Classifier 101 stores in advance a classification codebook formed with a plurality items of classification information indicating a plurality of types of narrowband LSP vectors, selects classification information indicating the type of a wideband LSP vector of the vector quantization target from the classification codebook, and outputs the classification information to switch 102 and scaling factor determining section 106. To be more specific, classifier 101 has a built-in classification codebook formed with code vectors associated with various types of narrowband LSP vectors, and finds a code vector to minimize the square error with an input narrowband LSP vector by searching the classification codebook. Further, classifier 101 uses the index of the code vector found by search, as classification information indicating the type of the LSP vector.

From first codebook 103, switch 102 selects one sub-codebook associated with the classification information received as input from classifier 101, and connects the output terminal of the sub-codebook to adder 104.

First codebook 103 stores in advance sub-codebooks (CBa1 to CBan) associated with the types of narrowband LSP's. That is, for example, when the number of types of narrowband LSP's is n, the number of sub-codebooks forming first codebook 103 is equally n. From a plurality of first code vectors forming the first codebook, first codebook 103 outputs first code vectors designated by designation from error minimization section 105, to switch 102.

Adder 104 calculates the differences between a wideband LSP vector received as an input vector quantization target and the code vectors received as input from switch 102, and outputs these differences to error minimization section 105 as first residual vectors. Further, out of the first residual vectors associated with all first code vectors, adder 104 outputs to multiplier 107 one minimum residual vector identified by searching in error minimization section 105.

Error minimization section 105 uses the results of squaring first residual vectors received as input from adder 104, as square errors of the wideband LSP vector and the first code vectors, and finds the first code vector to minimize the square error by searching the first codebook. Similarly, error square minimization section 105 uses the results of squaring second residual vectors received as input from adder 109, as square errors of the first residual vector and the second code vectors, and finds the second code vector to minimize the square error by searching the second codebook. Similarly, error square minimization section 105 uses the results of squaring third residual vectors received as input from adder 111, as square errors of the second residual vector and the third code vectors, and finds the third code vector to minimize the square error by searching the third codebook. Further, error minimization section 105 collectively encodes the indices assigned to the three code vectors acquired by searching, and outputs the result as encoded data.

Scaling factor determining section 106 stores in advance a scaling factor codebook formed with scaling factors associated with the types of narrowband LSP vectors. Further, from the scaling factor codebook, scaling factor determining section 106 selects a scaling factor associated with classification information received as input from classifier 101, and outputs the reciprocal of the selected scaling factor to multiplier 107. Here, a scaling factor may be a scalar or vector.

Multiplier 107 multiplies the first residual vector received as input from adder 104 by the reciprocal of the scaling factor received as input from scaling factor determining section 106, and outputs the result to adder 109.

Second codebook (CBb) 108 is formed with a plurality of second code vectors, and outputs second code vectors designated by designation from error minimization section 105 to adder 109.

Adder 109 calculates the differences between the first residual vector, which is received as input from multiplier 107 and multiplied by the reciprocal of the scaling factor, and the second code vectors received as input from second codebook 108, and outputs these differences to error minimization section 105 as second residual vectors. Further, out of the second residual vectors associated with all second code vectors, adder 109 outputs to adder 111 one minimum second residual vector identified by searching in error minimization section 105.

Third codebook 110 (CBc) is formed with a plurality of third code vectors, and outputs third code vectors designated by designation from error minimization section 105 to adder 111.

Adder 111 calculates the difference between the second residual vector received as input from adder 109 and the third code vectors received as input from third codebook 110, and outputs these differences to error minimization section 105 as third residual vectors.

Next, the operations performed by LSP vector quantization apparatus 100 will be explained, using an example case where the order of wideband LSP vectors of the quantization targets is R. Also, in the following explanation, wideband LSP vectors will be expressed by "LSP(i) (i=0, 1, . . . , R−1)."

Classifier 101 has a built-in classification codebook formed with n code vectors associated with n types of narrowband LSP vectors, and, by searching for code vectors, finds the m-th code vector to minimize the square error with an input narrowband LSP vector. Further, classifier 101 outputs m (1≦m≦n) to switch 102 and scaling factor determining section 106 as classification information.

Switch 102 selects the sub-codebook CBam associated with classification information m from first codebook 103, and connects the output terminal of that sub-codebook to adder 104.

From the first code vectors $CODE_1^{(d1)}(i)$ (d1=0, 1, . . . , D1−1, i=0, 1, . . . , R−1) forming CBam among n sub-codebooks CBa1 to CBan, first codebook 103 outputs to switch 102 the first code vectors $CODE_1^{(d1')}(i)$ (i=0, 1, . . . , R−1) designated by designation d1' from error minimization section 105. Here, D1 represents the total number of code vectors of the first codebook, and d1 represents the index of a first code vector. Further, error minimization section 105 sequentially designates the values of d1' from d1'=0 to d1'=D1−1, to first codebook 103.

According to the following equation 1, adder 104 calculates the differences between wideband LSP vector LSP(i) (i=0, 1, . . . , R−1) received as an input vector quantization targets and the first code vectors CODE_1(d1')(i) (i=0, 1, . . . , R−1) received as input from first codebook 103, and outputs these differences to error minimization section 105 as first residual vectors $Err_1^{(d1')}(i)$ (i=0, 1, . . . , R−1). Further, among first residual vectors $Err_1^{(d1')}(i)$ (i=0, 1, . . . , R−1) associated with d1'=0 to d1'=D1−1, adder 104 outputs the minimum first residual vector $Err_1^{(d1_min)}(i)$ (i=0, 1, . . . , R−1) identified by searching in error minimization section 105, to multiplier 107.

[1]

$$Err_1^{(d1')}(i)=LSP(i)-CODE_1^{(d1')}(i)\ (i=0, 1, \ldots, R-1) \quad \text{(Equation 1)}$$

Error minimization section 105 sequentially designates the values of d1 from d1'=0 to d1'=D1−1 to first codebook 103, and, with respect to the values of d1 from d1'=0 to d1'=D1−1, calculates square errors Err by squaring first residual vectors $Err_1^{(d1')}(i)$ (i=0, 1, . . . , R−1) received as input from adder 104 according to the following equation 2.

[2] (Equation 2)

$$Err = \sum_{i=0}^{R-1} \left(Err_1^{(d1')}(i)\right)^2$$

Error minimization section 105 stores the index d1' of the first code vector to minimize square error Err, as the first index d1_min.

Scaling factor determining section 106 selects the scaling factor $Scale^{(m)}(i)$ (i=0, 1, . . . , R−1) associated with classification information m from a scaling factor codebook, calculates the reciprocal of the scaling factor $Rec_Scale^{(m)}(i)$ according to the following equation 3, and outputs the reciprocal to multiplier 107.

[3] (Equation 3)

$$\mathrm{Rec_Scale}^{(m)}(i) = \frac{1}{Scale^{(m)}(i)} \quad (i = 0, 1, \ldots, R-1)$$

According to the following equation 4, multiplier 107 multiplies the first residual vector $\mathrm{Err_1}^{(d1_min)}(i)$ (i=0, 1, . . . , R−1) received as input from adder 104 by the reciprocal of the scaling factor $\mathrm{Rec_Scale}^{(m)}(i)$ (i=0, 1, . . . , R−1) received as input from scaling factor determining section 106, and outputs the result to adder 109.

[4]

$$\mathrm{Sca_Err_1}^{(d1_min)}(i)=\mathrm{Err_1}^{(d1_min)}(i)\times\mathrm{Rec_Scale}^{(m)}(i) \quad \text{(Equation 4)}$$

Among second code vectors $\mathrm{CODE_2}^{(d2)}(i)$ (d2=0, 1, . . . , D2−1, i=0, 1, . . . , R−1) forming the codebook, second codebook 108 outputs code vectors $\mathrm{CODE_2}^{(d2')}(i)$ (i=0, 1, . . . , R−1) designated by designation d2' from error minimization section 105, to adder 109. Here, D2 represents the total number of code vectors of the second codebook, and d2 represents the index of a code vector. Also, error minimization section 105 sequentially designates the values of d2' from d2'=0 to d2'=D2−1, to second codebook 108.

According to the following equation 5, adder 109 calculates the differences between first residual vector multiplied by the reciprocal of the scaling factor $\mathrm{Sca_Err_1}^{(d1_min)}(i)$ (i=0, 1, . . . , R−1) received as input from multiplier and second code vectors $\mathrm{CODE_2}^{(d2')}(i)$ (i=0, 1, . . . , R−1) received as input from second codebook 108, and outputs these differences to error minimization section 105 as second residual vectors $\mathrm{Err_2}^{(d2')}(i)$ (i=0, 1, . . . , R−1). Further, among second residual vectors $\mathrm{Err_2}^{(d2')}(i)$ (i=0, 1, . . . , R−1) associated with the values of d2' from d2'=0 to de'=D1−1, adder 109 outputs, to adder 111, the minimum second residual vector $\mathrm{Err_2}^{(d2_min)}(i)$ (i=0, 1, . . . , R−1) identified by searching in error minimization section 105.

[5]

$$\mathrm{Err_2}^{(d2')}(i)=\mathrm{Sca_Err_1}^{(d1_min)}(i)-\mathrm{Code_2}^{(d2')}(i) \quad (i=0, 1, \ldots, R-1) \quad \text{(Equation 5)}$$

Here, error minimization section 105 sequentially designates the values of d2' from d2'=0 to d2'=D2−1 to second codebook 108, and, with respect to the values of d2' from d2'=0 to d2'=D2−1, calculates the squarer errors Err by squaring second residual vectors $\mathrm{Err_2}^{(d2')}(i)$ (i=0, 1, . . . , R−1) received as input from adder 109 according to the following equation 6.

[6] (Equation 6)

$$Err = \sum_{i=0}^{R-1} \left(\mathrm{Err_2}^{(d2')}(i)\right)^2$$

Error minimization section 105 stores the index d2' of the second code vector to minimize square error Err as the second index d2_min.

Among third code vectors $\mathrm{CODE_3}^{(d3)}(i)$ (d3=0, 1, . . . , D3−1, i=0, 1, . . . , R−1) forming the codebook, third codebook 110 outputs third code vectors $\mathrm{CODE_3}^{(d3')}(i)$ (i=0, 1, . . . , R−1) designated by designation d3' from error minimization section 105, to adder 111. Here, D3 represents the total number of code vectors of the third codebook, and d3 represents the index of a code vector. Also, error minimization section 105 sequentially designates the values of d3' from d3'=0 to d3'=D3−1, to third codebook 110.

According to the following equation 7, adder 111 calculates the differences between second residual vector $\mathrm{Err_2}^{(d2_min)}(i)$ (i=0, 1, . . . , R−1) received as input from adder 109 and code vectors $\mathrm{CODE_3}^{(d3')}(i)$ (i=0, 1, . . . , R−1) received as input from third codebook 110, and outputs these differences to error minimization section 105 as third residual vectors $\mathrm{Err_3}^{(d3')}(i)$ (i=0, 1, . . . , R−1).

[7]

$$\mathrm{Err_3}^{(d3')}(i)=\mathrm{Err_2}^{(d2_min)}(i)-\mathrm{CODE_3}^{(d3')}(i) \quad (i=0, 1, \ldots, R-1) \quad \text{(Equation 7)}$$

Here, error minimization section 105 sequentially designates the values of d3' from d3'=1 to d3'=D3−1 to third codebook 110, and, with respect to the values of d3' from d3'=1 to d3'=D3−1, calculates square errors Err by squaring third residual vectors $\mathrm{Err_3}^{(d3')}(i)$ (i=0, 1, . . . , R−1) received as input from adder 111 according to the following equation 8.

[8] (Equation 8)

$$Err = \sum_{i=0}^{R-1} \left(\mathrm{Err_3}^{(d3')}(i)\right)^2$$

Next, error minimization section 105 stores the index d3' of the third code vector to minimize the square error Err, as the third index d3_min. Further, error minimization section 105 collectively encodes the first index d1_min, the second index d2_min and the third index d3_min, and outputs the result as encoded data.

Figure 2:
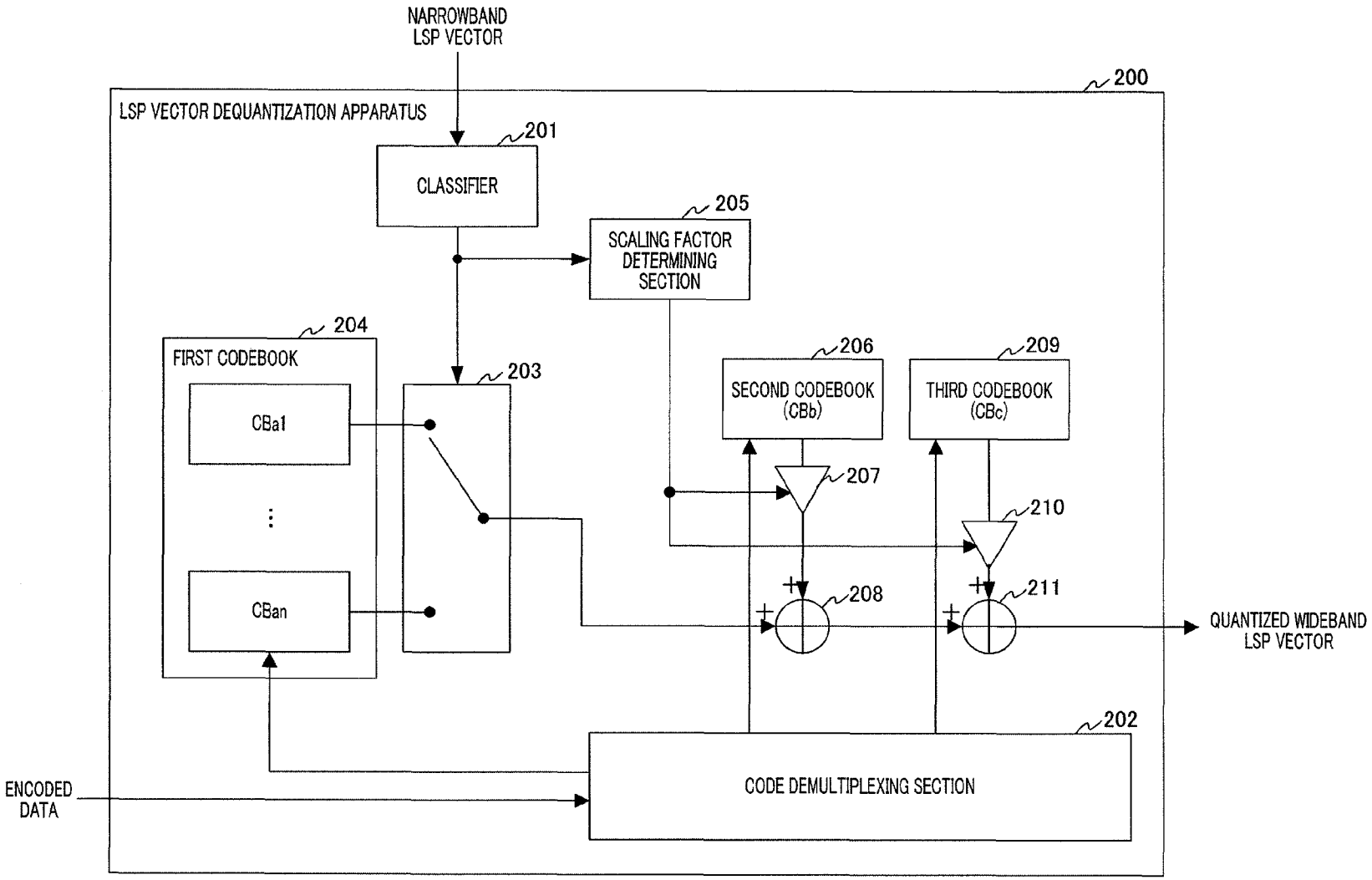
FIG. 2 is a block diagram showing main components of an LSP vector dequantization apparatus according to Embodiment 1.

FIG. 2 is a block diagram showing main components of LSP vector dequantization apparatus 200 according to the present embodiment. LSP vector dequantization apparatus 200 decodes encoded data outputted from LSP vector quantization apparatus 100, and generates quantized LSP vectors.

LSP vector dequantization apparatus 200 is provided with classifier 201, code demultiplexing section 202, switch 203, first codebook 204, scaling factor determining section 205, second codebook (CBb) 206, multiplier 207, adder 208, third codebook (CBc) 209, multiplier 210 and adder 211. Here, first codebook 204 provides sub-codebooks having the same contents as the sub-codebooks (CBa1 to CBan) of first codebook 103, and scaling factor determining section 205 provides a scaling factor codebook having the same contents as the scaling codebook of scaling factor determining section 106. Also, second codebook 206 provides a codebook having the same contents as the codebook of second codebook 108, and third codebook 209 provides a codebook having the same content as the codebook of third codebook 110.

Classifier 201 stores in advance a classification codebook formed with a plurality items of classification information indicating a plurality of types of narrowband LSP vectors, selects classification information indicating the type of a wideband LSP vector of the vector quantization target from the classification codebook, and outputs the classification information to switch 203 and scaling factor determining section 205. To be more specific, classifier 101 has a built-in classification codebook formed with code vectors associated with the types of narrowband LSP vectors, and finds the code vector to minimize the square error with a quantized narrowband LSP vector received as input from a narrowband LSP quantizer (not shown) by searching the classification codebook. Further, classifier 201 uses the index of the code vector found by searching, as classification information indicating the type of the LSP vector.

Code demultiplexing section 202 demultiplexes encoded data transmitted from LSP vector quantization apparatus 100, into the first index, the second index and the third index. Further, code demultiplexing section 202 directs the first index to first codebook 204, directs the second index to second codebook 206 and directs the third index to third codebook 209.

From first codebook 204, switch 203 selects one sub-codebook (CBam) associated with the classification information received as input from classifier 201, and connects the output terminal of the sub-codebook to adder 208.

Among a plurality of first code vectors forming the first codebook, first codebook 204 outputs to switch 203 one first code vector associated with the first index designated by code demultiplexing section 202.

From the scaling factor codebook, scaling factor determining section 205 selects a scaling factor associated with the classification information received as input from classifier 201, and outputs the scaling factor to multiplier 207 and multiplier 210.

Second codebook 206 outputs one second code vector associated with the second index designated by code demultiplexing section 202, to multiplier 207.

Multiplier 207 multiplies the second code vector received as input from second codebook 206 by the scaling factor received as input from scaling factor determining section 205, and outputs the result to adder 208.

Adder 208 adds the second code vector multiplied by the scaling factor received as input from multiplier 207 and the first code vector received as input from switch 203, and outputs the vector of the addition result to adder 211.

Third codebook 209 outputs one third code vector associated with the third index designated by code demultiplexing section 202, to multiplier 210.

Multiplier 210 multiplies the third code vector received as input from third codebook 209 by the scaling factor received as input from scaling factor determining section 205, and outputs the result to adder 211.

Adder 211 adds the third code vector multiplied by the scaling factor received as input from multiplier 210 and the vector received as input from adder 208, and outputs the vector of the addition result as a quantized wideband LSP vector.

Next, the operations of LSP vector dequantization apparatus 200 will be explained.

Classifier 201 has a built-in classification codebook formed with n code vectors associated with n types of narrowband LSP vectors, and finds the m-th code vector to minimize the square error with a quantized narrowband LSP vector received as input from a narrowband LSP quantizer (not shown) by searching for code vectors. Classifier 201 outputs m ($1 \leqq m \leqq n$) to switch 203 and scaling factor determining section 205 as classification information.

Code demultiplexing section 202 demultiplexes encoded data transmitted from LSP vector quantization apparatus 100, into the first index d1_min, the second index d2_min and the third index d3_min. Further, code demultiplexing section 202 directs the first index d1_min to first codebook 204, directs the second index d2_min to second codebook 206 and directs the third index d3_min to third codebook 209.

From first codebook 204, switch 203 selects sub-codebook CBam associated with classification information m received as input from classifier 201, and connects the output terminal of the sub-codebook to adder 208.

Among first code vectors $CODE_1^{(d1)}(i)$ (d1=0, 1, . . . , D1−1, i=0, 1, . . . , R−1) forming sub-codebook CBam, first codebook 204 outputs to switch 203 first code vector $CODE_1^{(d1_min)}(i)$(i=0, 1, . . . , R−1) designated by designation d1_min from code demultiplexing section 202.

Scaling factor determining section 205 selects scaling factor $Scale^{(m)}(i)$ (i=0, 1, . . . , R−1) associated with classification information m received as input from classifier 201, from the scaling factor codebook, and outputs the scaling factor to multiplier 207 and multiplier 210.

Among second code vectors $CODE_2^{(d2)}(i)$ (d2=0, 1, . . . , D2−1, i=0, 1, . . . , R−1) forming the second codebook, second codebook 206 outputs to multiplier 207 second code vector $CODE_2^{(d2_min)}(i)$ (i=0, 1, . . . , R−1) designated by designation d2_min from code demultiplexing section 202.

Multiplier 207 multiplies second code vector $CODE_2^{(d2_min)}(i)$ (i=0, 1, . . . , R−1) received as input from second codebook 206 by scaling factor $Scale^{(m)}(i)$ (i=0, 1, . . . , R−1) received as input from scaling factor determining section 205 according to the following equation 9, and outputs the result to adder 208.

[9]

$$Sca_Code_2^{(d2_min)}(i)=CODE_2^{(d2_min)}(i)\times Scale^{(m)}(i)\ (i=0, 1, \ldots, R-1) \quad \text{(Equation 9)}$$

According to the following equation 10, adder 208 adds first code vector $CODE_1^{(d1_min)}(i)$ (i=0, 1, . . . , R−1) received as input from first codebook 204 and second code vector multiplied by the scaling factor $CODE_2^{(d2_min)}(i)$ (i=0, 1, . . . , R−1) received as input from multiplier 207, and outputs the vector TMP(i) (i=0, 1, . . . , R−1) of the addition result to adder 211.

[10]

$$TMP(i)=CODE_1^{(d1_min)}(i)+Sca_CODE_2^{(d2_min)}(i)\ (i=0, 1, \ldots, R-1) \quad \text{(Equation 10)}$$

Among third code vectors $CODE_3^{(d3)}(i)$ (d3=0, 1, . . . , D3−1, i=0, 1, . . . , R−1) forming the codebook, third codebook 209 outputs third code vector $CODE_3^{(d3_min)}(i)$(i=0, 1, . . . , R−1) designated by designation d3_min from code demultiplexing section 202, to multiplier 210.

According to the following equation 11, multiplier 210 multiplies third code vector $CODE_3^{(d3_min)}(i)$ (i=0, 1, . . . , R−1) received as input from third codebook 209 by scaling factor $Scale^{(m)}(i)$ (i=0, 1, . . . , R−1) received as input from scaling factor determining section 205, and outputs the result to adder 211.

[11]

$$Sca_CODE_3^{(d3_min)}(i)=CODE_3^{(d3_min)}(i)\times Scale^{(m)}(i)\ (i=0, 1, \ldots, R-1) \quad \text{(Equation 11)}$$

According to the following equation 12, adder 211 adds vector TMP(i) (i=0, 1, . . . , R−1) received as input from adder 208 and third code vector multiplied by the scaling factor $Sca_CODE_3^{(d3_min)}(i)$ (i=0, 1, . . . , R−1) received as input from multiplier 210, and outputs the vector Q_LSP(i) (i=0, 1, . . . , R−1) of the addition result as a quantized wideband LSP vector.

[12]

$$Q_LSP(i)=TMP(i)+Sca_CODE_3^{(d3_min)}(i)\ (i=0, 1, \ldots, R-1) \quad \text{(Equation 12)}$$

The first codebooks, second codebooks, third codebooks and scaling factor codebooks used in LSP vector quantization apparatus 100 and LSP vector dequantization apparatus 200 are provided in advance by learning. The method of learning these codebooks will be explained below as an example.

To acquire the first codebook provided in first codebook 103 and first codebook 204 by learning, first, a large number (e.g., V) of LSP vectors are prepared from a large amount of speech data for learning. Next, by grouping V LSP vectors per type (i.e. by grouping n types) and calculating D1 first code vectors $CODE_1^{(d1)}(i)$ ($d1=0, 1, \ldots, D1-1$, $i=0, 1, \ldots, R-1$) using the LSP vectors of each group according to learning algorithms such as the LBG (Linde Buzo Gray) algorithm, n sub-codebooks are generated.

To acquire the second codebook provided in second codebook 108 and second codebook 206 by learning, by performing vector quantization in the first stage using the first codebook generated by the above method, V first residual vectors $Err_1^{(d1_min)}(i)$ ($i=0, 1, \ldots, R-1$) outputted from adder 104 are acquired. Next, by calculating D2 second code vectors $CODE_2^{(d2)}(i)$ ($d2=0, 1, \ldots, D2-1$, $i=0, 1, \ldots, R-1$) using V first residual vectors $Err_1^{(d1_min)}(i)$ ($i=0, 1, \ldots, R-1$) according to learning algorithms such as the LBG algorithm, the second codebook is generated.

To acquire the third codebook provided in third codebook 110 and third codebook 209 by learning, by performing vector quantization in the first and second stages using the first and second codebooks generated by the above methods, V second residual vectors $Err_2^{(d2_min)}(i)$ ($i=0, 1, \ldots, R-1$) outputted from adder 109 are acquired. Next, by calculating D3 third code vectors $CODE_3^{(d3)}(i)$ ($d3=0, 1, \ldots, D3-1$, $i=0, 1, \ldots, R-1$) using V second residual vectors $Err_2^{(d2_min)}(i)$ ($i=0, 1, \ldots, R-1$) according to learning algorithms such as the LBG algorithm, the third codebook is generated. Here, a scaling factor codebook is not generated yet, and, consequently, multiplier 107 does not operate, and the output of adder 104 is received as input in adder 109 as is.

To acquire the scaling factor codebook provided in scaling factor determining section 106 and scaling factor determining section 205 by learning, when the value of a scaling factor is $\alpha$, by performing vector quantization in the first to third stages using the first to third codebooks generated by the above methods, V quantized LSP's are calculated. Next, the average value of spectral distortion (or cepstral distortion) between V LSP vectors and V quantized LSP vectors received as input, is calculated. In this case, an essential requirement is to gradually change the value of $\alpha$ in the range of, for example, 0.8 to 1.2, calculate spectral distortions respectively associated with the values of $\alpha$, and use the value of $\alpha$ to minimize the spectral distortion as a scaling factor. By determining the value of $\alpha$ per narrowband LSP vector type, the scaling factor associated with each type is determined, so that a scaling factor codebook is generated using these scaling factors. Also, when a scaling factor is a vector, an essential requirement is to perform learning as above per vector element.

Thus, according to the present embodiment, in multi-stage vector quantization in which codebooks for vector quantization in the first stage are switched based on the types of narrowband LSP vectors correlated with wideband LSP vectors and the statistical dispersion of vector quantization errors (i.e. first residual vectors) in the first stage varies between types, a quantized residual vector in the first stage is multiplied by a scaling factor associated with a classification result of a narrowband LSP vector, so that it is possible to change the dispersion of vectors of the vector quantization targets in the second and third stages according to the statistical dispersion of vector quantization errors in the first stage, and therefore improve the accuracy of quantization of wideband LSP vectors.

Also, in the vector dequantization apparatus, by receiving as input encoded data of wideband LSP vectors generated by the quantizing method with improved quantization accuracy and performing vector dequantization, it is possible to generate accurate quantized wideband LSP vectors. Also, by using such a vector dequantization apparatus in a speech decoding apparatus, it is possible to decode speech using accurate quantized wideband LSP vectors, so that it is possible to acquire decoded speech of high quality.

Also, although an example case has been described above with the present embodiment where the scaling factors forming the scaling factor codebook provided in scaling factor determining section 106 and scaling factor determining section 205 are associated with the types of narrowband LSP vectors, the present invention is not limited to this, and the scaling factors forming the scaling factor codebook provided in scaling factor determining section 106 and scaling factor determining section 205 may be associated with the types classifying the features of speech. In this case, classifier 101 receives parameters representing the feature of speech as input speech feature information instead of a narrowband LSP vector, and outputs the type of the feature of the speech associated with the speech feature information received as input, to switch 102 and scaling factor determining section 106 as classification information. When the present invention is applied to a coding apparatus that switches the type of the encoder by features such as a voiced characteristic and unvoiced characteristic of speech like, for example, VMR-WB (variable-rate multimode wideband speech codec), information about the type of the encoder can be used as is as the amount of features of speech.

Also, although an example case has been described above with the present embodiment where scaling factor determining section 106 outputs the reciprocals of scaling factors associated with types received as input from classifier 101, the present invention is not limited to this, and it is equally possible to calculate the reciprocals of scaling factors in advance and store the calculated reciprocals of the scaling factors in a scaling factor codebook.

Also, although an example case has been described above with the present embodiment where vector quantization of three steps is performed for LSP vectors, the present invention is not limited to this, and is equally applicable to the case of vector quantization of two steps or the case of vector quantization of four or more steps.

Also, although a case has been described above with the present embodiment where multi-stage vector quantization of three steps is performed for LSP vectors, the present invention is not limited to this, and is equally applicable to the case where vector quantization is performed together with split vector quantization.

Also, although an example case has been described above with the present embodiment where wideband LSP vectors are used as the quantization targets, the quantization target is not limited to this, and it is equally possible to use vectors other than wideband LSP vectors.

Also, although a case has been described above with the present embodiment where LSP vector dequantization apparatus 200 decodes encoded data outputted from LSP vector quantization apparatus 100, the present invention is not limited to this, and it is needless to say that LSP vector dequantization apparatus 200 can receive and decode encoded data as long as the encoded data is in a form that can be decoded by LSP vector dequantization apparatus 200.

Embodiment 2

Figure 3:
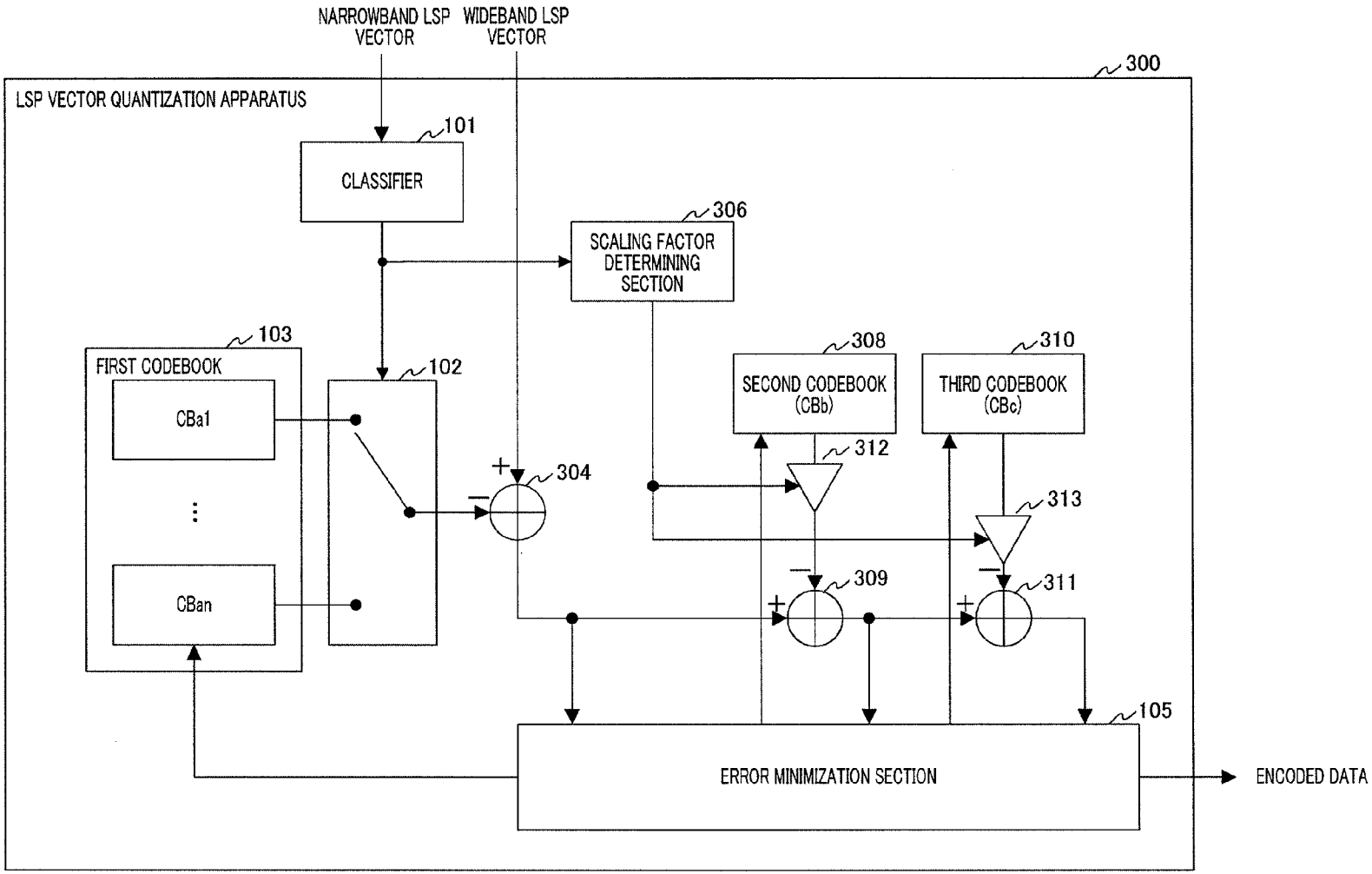
FIG. 3 is a block diagram showing main components of an LSP vector quantization apparatus according to Embodiment 2.

FIG. 3 is a block diagram showing main components of LSP vector quantization apparatus 300 according to Embodiment 2 of the present invention. Also, LSP vector quantization apparatus 300 has the same basic configuration as in LSP vector quantization apparatus 100 (see FIG. 1) shown in Embodiment 1, and the same components will be assigned the same reference numerals and their explanations will be omitted.

LSP vector quantization apparatus 300 is provided with classifier 101, switch 102, first codebook 103, adder 304, error minimization section 105, scaling factor determining section 306, second codebook 308, adder 309, third codebook 310, adder 311, multiplier 312 and multiplier 313.

Adder 304 calculates the differences between a wideband LSP vector received as the input vector quantization target from the outside and first code vectors received as input from switch 102, and outputs these differences to error minimization section 105 as first residual vectors. Also, among the first residual vectors associated with all first code vectors, adder 304 outputs one minimum first residual vector identified by searching in error minimization section 105, to adder 309.

Scaling factor determining section 306 stores in advance a scaling factor codebook formed with scaling factors associated with the types of narrowband LSP vectors. Scaling factor determining section 306 outputs a scaling factor associated with classification information received as input from classifier 101, to multiplier 312 and multiplier 313. Here, a scaling factor may be a scalar or vector.

Second codebook (CBb) 308 is formed with a plurality of second code vectors, and outputs second code vectors designated by designation from error minimization section 105, to multiplier 312.

Third codebook (CBc) 310 is formed with a plurality of third code vectors, and outputs third code vectors designated by designation from error minimization section 105, to multiplier 313.

Multiplier 312 multiplies the second code vectors received as input from second codebook 308 by the scaling factor received as input from scaling factor determining section 306, and outputs the results to adder 309.

Adder 309 calculates the differences between the first residual vector received as input from adder 304 and the second code vectors multiplied by the scaling factor received as input from multiplier 312, and outputs these differences to error minimization section 105 as second residual vectors. Also, among the second residual vectors associated with all second code vectors, adder 309 outputs one minimum second residual vector identified by searching in error minimization section 105, to adder 311.

Multiplier 313 multiplies third code vectors received as input from third codebook 310 by the scaling factor received as input from scaling factor determining section 306, and outputs the results to adder 311.

Adder 311 calculates the differences between the second residual vector received as input from adder 309 and the third code vectors multiplied by the scaling factor received as input from multiplier 313, and outputs these differences to error minimization section 105 as third residual vectors.

Next, the operations performed by LSP vector quantization apparatus 300 will be explained, using an example case where the order of LSP vectors of the quantization targets is R. Also, in the following explanation, LSP vectors will be expressed by "LSP(i) (i=0, 1, . . . , R−1)."

According to the following equation 13, adder 304 calculates the differences between wideband LSP vector LSP(i) (i=0, 1, . . . , R−1) and first code vectors $CODE_1^{(d1')}(i)$ (i=0, 1, . . . , R−1) received as input from first codebook 103, and outputs these differences to error minimization section 105 as first residual vectors $Err_1^{(d1')}(i)$ (i=0, 1, . . . , R−1). Also, among first residual vectors $Err_1^{(d1')}(i)$ (i=0, 1, . . . , R−1) associated with d1' from d1'=0 to d1'=D1−1, adder 304 outputs minimum first residual vector $Err_1^{(d1_min)}(i)$ (i=0, 1, . . . , R−1) identified by searching in error minimization section 105, to adder 309.

[13]

$$Err_1^{(d1')}(i)=LSP(i)-CODE_1^{(d1')}(i)\ (i=0, 1, \ldots, R-1) \quad \text{(Equation 13)}$$

Scaling factor determining section 306 selects scaling factor $Scale^{(m)}(i)$ (i=0, 1, . . . , R−1) associated with classification information m from the scaling factor codebook, and outputs the scaling factor to multiplier 312 and multiplier 313.

Among second code vectors CODE_2(d2)(i) (d2=0, 1, . . . , D2−1, i=0, 1, . . . , R−1) forming the codebook, second codebook 308 outputs code vectors CODE_2(d2')(i) (i=0, 1, . . . , R−1) designated by designation d2' from error minimization section 105, to multiplier 312. Here, D2 represents the total number of code vectors of the second codebook, and d2 represents the index of a code vector. Also, error minimization section 105 sequentially designates the values of d2' from d2'=0 to d2'=D2−1, to second codebook 308.

According to the following equation 14, multiplier 312 multiplies second vectors $CODE_2^{(d2')}(i)$ (i=0, 1, . . . , R−1) received as input from second codebook 308 by scaling factor $Scale^{(m)}(i)$ (i=0, 1, . . . , R−1) received as input from scaling factor determining section 306, and outputs the results to adder 309.

[14]

$$Sca_CODE_2^{(d2')}(i)=CODE_2^{(d2')}(i)\times Scale^{(m)}(i)\ (i=0, 1, \ldots, R-1) \quad \text{(Equation 14)}$$

According to the following equation 15, adder 309 calculates the differences between first residual vector $Err_1^{(d1_min)}(i)$ (i=0, 1, . . . , R−1) received as input from adder 304 and second code vectors multiplied by the scaling factor $Sca_CODE_2^{(d2')}(i)$ (i=0, 1, . . . , R−1) received as input from multiplier 312, and outputs these differences to error minimization section 105 as second residual vectors $Err_2^{(d2')}(i)$ (i=0, 1, . . . , R−1). Further, among second residual vectors $Err_2^{(d2')}(i)$ (i=0, 1, . . . , R−1) associated with d2' from d2'=0 to d2'=D1−1, adder 309 outputs minimum second residual vector $Err_2^{(d2_min)}(i)$ (i=0, 1, . . . , R−1) identified by searching in error minimization section 105, to adder 311.

[15]

$$Err_2^{(d2')}(i)=Err_1^{(d1_min)}(i)-Sca_CODE_2^{(d2')}(i)\ (i=0, 1, \ldots, R-1) \quad \text{(Equation 15)}$$

Among third code vectors CODE_3(d3)(i) (d3=0, 1, . . . , D3−1, i=0, 1, . . . , R−1) forming the codebook, third codebook 310 outputs code vectors CODE_3(d3')(i) (i=0, 1, . . . , R−1) designated by designation d3' from error minimization section 105, to multiplier 313. Here, D3 represents the total number of code vectors of the third codebook, and d3 represents the index of a code vector. Also, error minimization section 105 sequentially designates the values of d3' from d3'=0 to d3'=D3−1, to third codebook 310.

According to the following equation 16, multiplier 313 multiplies third code vectors $CODE_3^{(d3')}(i)$ (i=0, 1, . . . , R−1) received as input from third codebook 310 by scaling factor $Scale^{(m)}(i)$ (i=0, 1, . . . , R−1) received as input from scaling factor determining section 306, and outputs the results to adder 311.

[16]

$$Sca_CODE_3^{(d3')}(i)=CODE_3^{(d3')}(i)\times Scale^{(m)}(i) \quad (i=0, 1, \ldots, R-1) \qquad \text{(Equation 16)}$$

According to the following equation 17, adder 311 calculates the differences between second residual vector $Err_2^{(d2_min)}(i)$ (i=0, 1, . . . , R−1) received as input from adder 309 and third code vectors multiplied by the scaling factor $Sca_CODE_3^{(d3')}(i)$ (i=0, 1, . . . , R−1) received as input from multiplier 313, and outputs these differences to error minimization section 105 as third residual vectors $Err_3^{(d3')}(i)$ (i=0, 1, . . . , R−1).

Thus, according to the present embodiment, in multi-stage vector quantization in which codebooks for vector quantization in the first stage are switched based on the types of narrowband LSP vectors correlated with wideband LSP vectors and the statistical dispersion of vector quantization errors (i.e. first residual vectors) in the first stage varies between types, a second codebook used for vector quantization in the second and third stages and code vectors of the second codebook are multiplied by a scaling factor associated with a classification result of a narrowband LSP vector, so that it is possible to change the dispersion of vectors of the vector quantization targets in the second and third stages according to the statistical dispersion of vector quantization errors in the first stage, and therefore improve the accuracy of quantization of wideband LSP vectors.

Also, second codebook 308 according to the present embodiment may have the same contents as second codebook 108 according to Embodiment 1, and third codebook 310 according to the present embodiment may have the same contents as third codebook 110 according to Embodiment 1. Also, scaling factor determining section 306 according to the present embodiment may provide a codebook having the same contents as the scaling factor codebook provided in scaling factor determining section 106 according to Embodiment 1.

Embodiment 3

Figure 4:
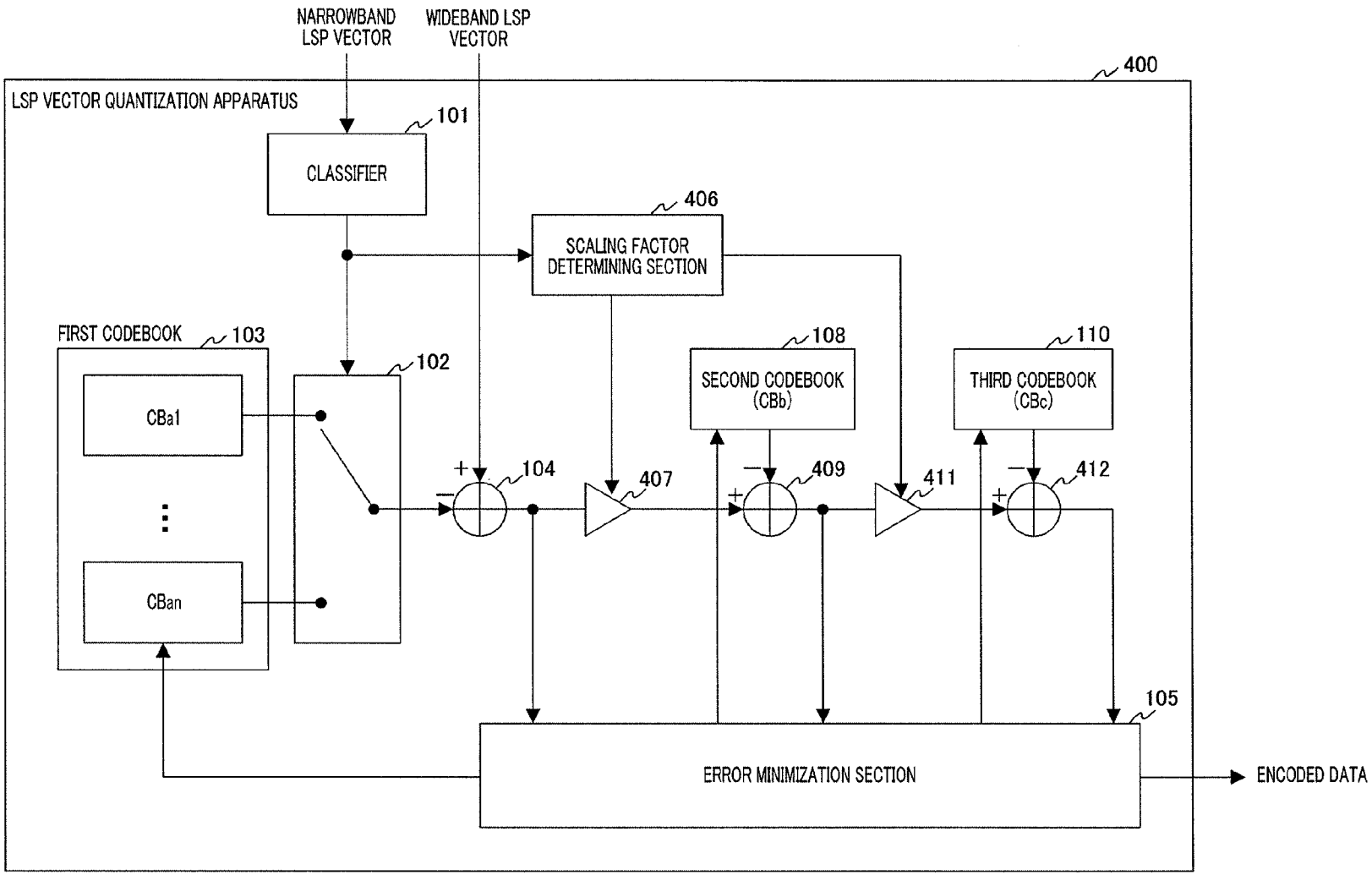
FIG. 4 is a block diagram showing main components of an LSP vector quantization apparatus according to Embodiment 3.

FIG. 4 is a block diagram showing main components of LSP vector quantization apparatus 400 according to Embodiment 3 of the present invention. Here, LSP vector quantization apparatus 400 has the same basic configuration as in LSP vector quantization apparatus 100 (see FIG. 1), and the same components will be assigned the same reference numerals and their explanations will be omitted.

LSP vector quantization apparatus 400 is provided with classifier 101, switch 102, first codebook 103, adder 104, error minimization section 105, scaling factor determining section 406, multiplier 407, second codebook 108, adder 409, third codebook 110, adder 412 and multiplier 411.

Scaling factor determining section 406 stores in advance a scaling factor codebook formed with scaling factors associated with the types of narrowband LSP vectors. Scaling factor determining section 406 determines the scaling factors associated with classification information received as input from classifier 101. Here, scaling factors are formed with the scaling factor by which the first residual vector outputted from adder 104 is multiplied (i.e. the first scaling factor) and the scaling factor by which the first residual vector outputted from adder 409 is multiplied (i.e. the second scaling factor). Next, scaling factor determining section 406 outputs the first scaling factor to multiplier 407 and outputs the second scaling factor to multiplier 411. Thus, by preparing in advance scaling factors suitable for the stages of multi-stage vector quantization, it is possible to perform an adaptive adjustment of codebooks in more detail.

Multiplier 407 multiplies the first residual vector received as input from adder 104 by the reciprocal of the first scaling factor outputted from scaling factor determining section 406, and outputs the result to adder 409.

Adder 409 calculates the differences between the first residual vector multiplied by the reciprocal of the scaling factor received as input from multiplier 407 and second code vectors received as input from second codebook 108, and outputs these differences to error minimization section 105 as second residual vectors. Also, among second residual vectors associated with all second code vectors, adder 409 outputs one minimum second residual vector identified by searching in error minimization section 105, to multiplier 411.

Multiplier 411 multiplies the second residual vector received as input from adder 409 by the reciprocal of the second scaling factor received as input from scaling factor determining section 406, and outputs the result to adder 412.

Adder 412 calculates the differences between the second residual vector multiplied by the reciprocal of the scaling factor received as input from multiplier 411 and third code vectors received as input from third codebook 110, and outputs these differences to error minimization section 105 as third residual vectors.

Next, the operations performed by LSP vector quantization apparatus 400 will be explained, using an example case where the order of LSP vectors of the quantization targets is R. Also, in the following explanation, LSP vectors will be expressed by "LSP(i) (i=0, 1, . . . , R−1)."

Scaling factor determining section 406 selects first scaling factor $Scale_1^{(m)}(i)$ (i=0, 1, . . . , R−1) and second scaling factor $Scale_2^{(m)}(i)$ (i=0, 1, . . . , R−1) associated with classification information m from a scaling factor codebook, calculates the reciprocal of first scaling factor $Scale_1^{(m)}(i)$ (i=0, 1, . . . , R−1) according to the following equation 17 and outputs the reciprocal to multiplier 407, and calculates the reciprocal of second scaling factor $Scale_2^{(m)}(i)$ (i=0, 1, . . . , R−1) according to the following equation 18 and outputs the reciprocal to multiplier 411.

[17] (Equation 17)

$$Rec_Scale_1^{(m)}(i) = \frac{1}{Scale_1^{(m)}(i)} \quad (i = 0, 1, \ldots, R-1)$$

[18] (Equation 18)

$$Rec_Scale_2^{(m)}(i) = \frac{1}{Scale_2^{(m)}(i)} \quad (i = 0, 1, \ldots, R-1)$$

Here, although a case has been described above where scaling factors are selected and then their reciprocals are calculated, by calculating the reciprocals of scaling factors in advance and storing them in a scaling codebook, it is possible to omit the operations for calculating the reciprocals of scaling factors. Even in this case, the present invention can provide the same effect as above.

According to the following equation 19, multiplier 407 multiplies first residual vector $Err_1^{(d1_min)}(i)$ (i=0, 1, . . . , R−1) received as input from adder 104 by the reciprocal of first scaling factor $Rec_Scale_1^{(m)}(i)$ (i=0, 1, . . . , R−1)

received as input from scaling factor determining section 406, and outputs the result to adder 409.

[19]

$$\text{Sca_Err_1}^{(d1_min)}(i)=\text{Err_1}^{(d1_min)}(i)\times \text{Rec_Scale_1}^{(m)}(i)\ (i=0, 1, \ldots, R-1) \quad \text{(Equation 19)}$$

According to the following equation 20, adder 409 calculates the differences between first residual vector multiplied by the reciprocal of the first scaling factor $\text{Sca_Err_1}^{(d1_min)}(i)$ (i=0, 1, . . . , R−1) received as input from multiplier 407 and second code vectors $\text{CODE_2}^{(d2')}(i)$ (i=0, 1, . . . , R−1) received as input from second code vector 108, and outputs these differences to error minimization section 105 as second residual vectors $\text{Err_2}^{(d2')}(i)$ (i=0, 1, . . . , R−1). Further, among second residual vectors $\text{Err_2}^{(d2')}(i)$ (i=0, 1, . . . , R−1) associated with the values of d2' from d2'=0 to d2'=D1−1, adder 409 outputs minimum second residual vector $\text{Err_2}^{(d2_min)}(i)$ (i=0, 1, . . . , R−1) identified by searching in error minimization section 105, to multiplier 411.

[20]

$$\text{Err_2}^{(d2')}(i)=\text{Sca_Err_1}^{(d1_min)}(i)-\text{CODE_2}^{(d2')}(i) \quad (i=0, 1, \ldots, R-1) \quad \text{(Equation 20)}$$

According to the following equation 21, multiplier 411 multiplies second residual vector $\text{Err_2}^{(d2_min)}(i)$ (i=0, 1, . . . , R−1) received as input from adder 409 by the reciprocal of second scaling factor $\text{Rec_Scale_2}^{(m)}(i)$ (i=0, 1, . . . , R−1) received as input from scaling factor determining section 406, and outputs the result to adder 412.

[21]

$$\text{Sca_Err_2}^{(d2_min)}(i)=\text{Err_2}^{(d2_min)}(i)\times \text{Rec_Scale_2}^{(m)}(i)\ (i=0, 1, \ldots, R-1) \quad \text{(Equation 21)}$$

According to the following equation 22, adder 412 calculates the differences between second residual vector multiplied by the reciprocal of second scaling factor $\text{Sca_Err_2}^{(d2_min)}(i)$ (i=0, 1, . . . , R−1) received as input from multiplier 411 and third code vectors $\text{CODE_3}^{(d3')}(i)$ (i=0, 1, . . . , R−1) received as input from third codebook 110, and outputs these differences to error minimization section 105 as third residual vectors $\text{Err_3}^{(d3')}(i)$ (i=0, 1, . . . , R−1).

[22]

$$\text{Err_3}^{(d3')}(i)=\text{Sca_Err_2}^{(d2_min)}(i)-\text{CODE_3}^{(d3')}(i) \quad (i=0, 1, \ldots, R-1) \quad \text{(Equation 22)}$$

Thus, according to the present embodiment, in multi-stage vector quantization in which codebooks for vector quantization in the first stage are switched based on the types of narrowband LSP vectors correlated with wideband LSP vectors and the statistical dispersion of vector quantization errors (i.e. first residual vectors) in the first stage varies between types a second codebook used for vector quantization in the second and third stages and code vectors of the third codebook are multiplied by scaling factors associated with a classification result of a narrowband LSP vector, so that it is possible to change the dispersion of vectors of the vector quantization targets in the second and third stages according to the statistical dispersion of vector quantization errors in the first stage, and therefore improve the accuracy of quantization of wideband LSP vectors. Here, by preparing the scaling factor used in the second stage and the scaling factor used in the third stage separately, more detailed adaptation is possible.

Figure 5:
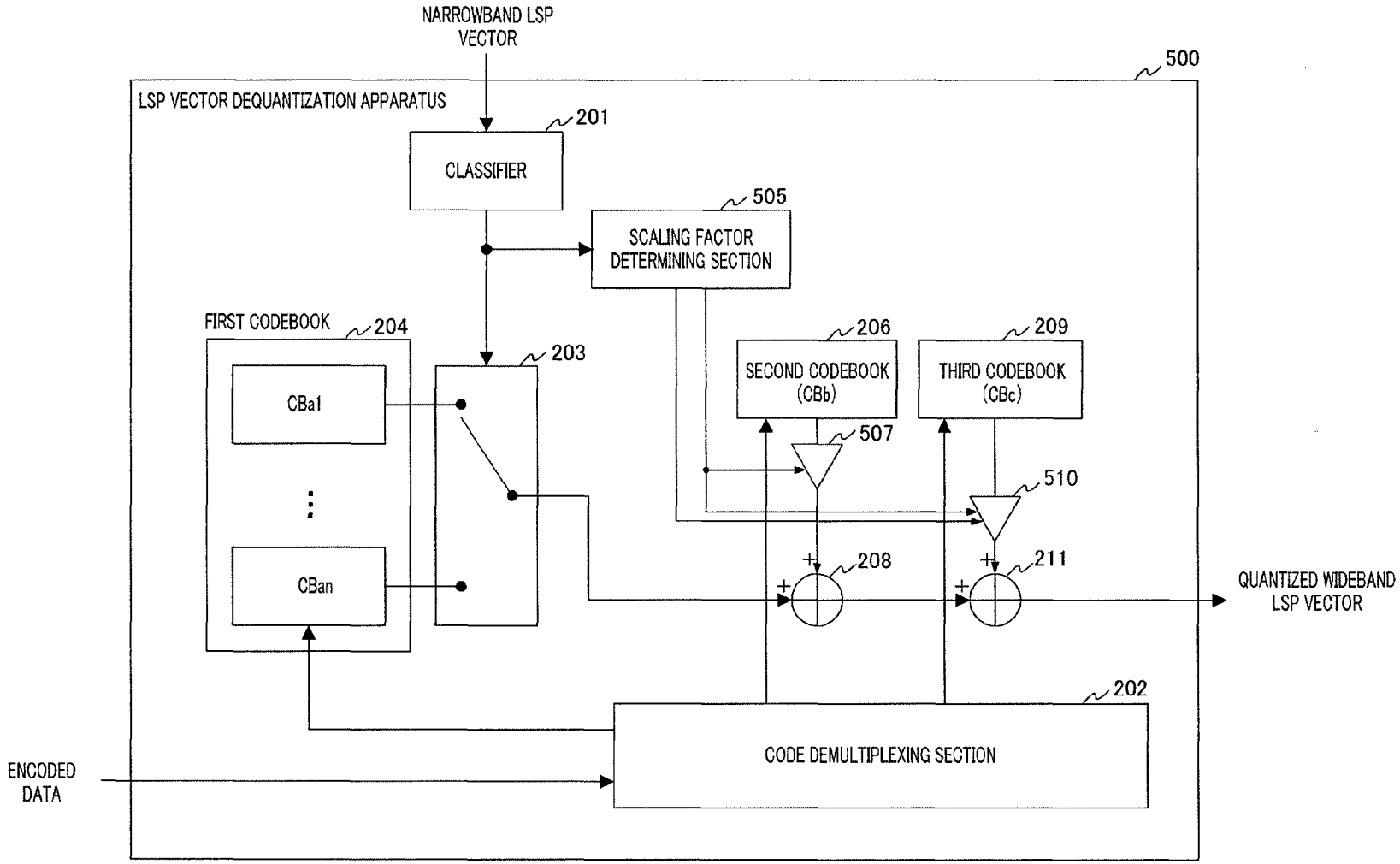
FIG. 5 is a block diagram showing main components of an LSP vector dequantization apparatus according to Embodiment 3.

FIG. 5 is a block diagram showing main components of LSP vector dequantization apparatus 500 according to the present embodiment. LSP vector dequantization apparatus 500 decodes encoded data outputted from LSP vector quantization apparatus 400 and generates quantized LSP vectors. Also, LSP vector dequantization apparatus 500 has the same basic configuration as in LSP vector dequantization apparatus 200 (see FIG. 2) shown in Embodiment 1, and the same components will be assigned the same reference numerals and their explanations will be omitted.

LSP vector dequantization apparatus 500 is provided with classifier 201, code demultiplexing section 202, switch 203, first codebook 204, scaling factor determining section 505, second codebook (CBb) 206, multiplier 507, adder 208, third codebook (CBc) 209, multiplier 510 and adder 211. Here, first codebook 204 provides sub-codebooks having the same contents as the sub-codebooks (CBa1 to CBan) of first codebook 103, and scaling factor determining section 505 provides a scaling factor codebook having the same contents as the scaling codebook of scaling factor determining section 406. Also, second codebook 206 provides a codebook having the same contents as the codebook of second codebook 108, and third codebook 209 provides a codebook having the same contents as the codebook of third codebook 110.

From a scaling factor codebook, scaling factor determining section 505 selects first scaling factor $\text{Scale_1}^{(m)}(i)$ (i=0, 1, . . . , R−1) and second scaling factor $\text{Scale_2}^{(m)}(i)$ (i=0, 1, . . . , R−1) associated with classification information m received as input from classifier 201, outputs first scaling factor $\text{Scale_1}^{(m)}(i)$ (i=0, 1, . . . , R−1) to multiplier 507 and multiplier 510, and outputs second scaling factor $\text{Scale_2}^{(m)}(i)$ (i=0, 1, . . . , R−1) to multiplier 510.

According to the following equation 23, multiplier 507 multiplies second code vector $\text{CODE_2}^{(d2_min)}(i)$ (i=0, 1, . . . , R−1) received as input from second codebook 206 and first scaling factor $\text{Scale_1}^{(m)}(i)$ (i=0, 1, . . . , R−1) received as input from scaling factor determining section 505, and outputs the result to adder 208.

[23]

$$\text{Sca_CODE_2}^{(d2_min)}=\text{CODE_2}^{(d2_min)}(i)\times \text{Scale_1}^{(m)}(i)\ (i=0, 1, \ldots, R-1) \quad \text{(Equation 23)}$$

According to the following equation 24, multiplier 510 multiplies third code vector $\text{CODE_3}^{(d3_min)}(i)$ (i=0, 1, . . . , R−1) received as input from third codebook 209 by first scaling factor $\text{Scale_1}^{(m)}(i)$ (i=0, 1, . . . , R−1) and second scaling factor $\text{Scale_2}^{(m)}(i)$ (i=0, 1, . . . , R−1) received as input from scaling factor determining section 505, and outputs the result to adder 211.

[24]

$$\text{Sca_CODE_3}^{(d3_min)}(i)=\text{CODE_3}^{(d3_min)}(i)\times \text{Scale_1}^{(m)}(i)\times\text{Scale_2}^{(m)}(i)\ (i=0, 1, \ldots, R-1) \quad \text{(Equation 24)}$$

Thus, according to the present embodiment, an LSP vector dequantization apparatus receives as input and performs vector dequantization of encoded data of wideband LSP vectors generated by the quantizing method with improved quantization accuracy, so that it is possible to generate accurate quantized wideband LSP vectors. Also, by using such a vector dequantization apparatus in a speech decoding apparatus, it is possible to decode speech using accurate quantized wideband LSP vectors, so that it is possible to acquire decoded speech of high quality.

Also, although a case has been described above where LSP vector dequantization apparatus 500 decodes encoded data outputted from LSP vector quantization apparatus 400, the present invention is not limited to this, and it is needless to say that LSP vector dequantization apparatus 500 can receive and decode encoded data as long as the encoded data is in a form that can be decoded by LSP vector dequantization apparatus 500.

Embodiments of the present invention have been described above.

Also, the vector quantization apparatus, the vector dequantization apparatus and the vector quantization and dequantization methods according to the present embodiment are not limited to the above embodiments, and can be implemented with various changes.

For example, although the vector quantization apparatus, the vector dequantization apparatus and the vector quantization and dequantization methods have been described above with embodiments targeting speech signals, these apparatuses and methods are equally applicable to audio signals and so on.

Also, LSP can be referred to as "LSF (Line Spectral Frequency)," and it is possible to read LSP as LSF. Also, when ISP (Immittance Spectrum Pairs) is quantized as spectrum parameters instead of LSP, it is possible to read LSP as ISP and utilize an ISP quantization/dequantization apparatus in the present embodiments. Also, when ISF (Immittance Spectrum Frequency) is quantized as spectrum parameters instead of LSP, it is possible to read LSP as ISF and utilize an ISF quantization/dequantization apparatus in the present embodiments.

Also, the vector quantization apparatus, the vector dequantization apparatus and the vector quantization and dequantization methods according to the present invention can be used in a CELP coding apparatus and CELP decoding apparatus that encodes and decodes speech signals, audio signals, and so on. For example, in a case where the LSP vector quantization apparatus according to the present invention is applied to a CELP speech coding apparatus, in the CELP coding apparatus, LSP vector quantization apparatus 100 according to the present invention is provided in an LSP quantization section that: receives as input and performs quantization processing of LSP converted from linear prediction coefficients acquired by performing a liner prediction analysis of an input signal; outputs the quantized LSP to a synthesis filter; and outputs a quantized LSP code indicating the quantized LSP as encoded data. By this means, it is possible to improve the accuracy of vector quantization, so that it is equally possible to improve speech quality upon decoding. Similarly, in the case where the LSP vector dequantization apparatus according to the present invention is applied to a CELP speech decoding apparatus, in the CELP decoding apparatus, by providing LSP vector quantization apparatus 200 according to the present invention in an LSP dequantization section that decodes quantized LSP from a quantized LSP code acquired by demultiplexing received, multiplexed encoded data and outputs the decoded quantized LSP to a synthesis filter, it is possible to provide the same effect as above.

The vector quantization apparatus and the vector dequantization apparatus according to the present invention can be mounted on a communication terminal apparatus in a mobile communication system that transmits speech, audio and such, so that it is possible to provide a communication terminal apparatus having the same operational effect as above.

Although a case has been described with the above embodiments as an example where the present invention is implemented with hardware, the present invention can be implemented with software. For example, by describing the vector quantization method and vector dequantization method according to the present invention in a programming language, storing this program in a memory and making the information processing section execute this program, it is possible to implement the same function as in the vector quantization apparatus and vector dequantization apparatus according to the present invention.

Furthermore, each function block employed in the description of each of the aforementioned embodiments may typically be implemented as an LSI constituted by an integrated circuit. These may be individual chips or partially or totally contained on a single chip.

"LSI" is adopted here but this may also be referred to as "IC," "system LSI," "super LSI," or "ultra LSI" depending on differing extents of integration.

Further, the method of circuit integration is not limited to LSI's, and implementation using dedicated circuitry or general purpose processors is also possible. After LSI manufacture, utilization of an FPGA (Field Programmable Gate Array) or a reconfigurable processor where connections and settings of circuit cells in an LSI can be reconfigured is also possible.

Further, if integrated circuit technology comes out to replace LSI's as a result of the advancement of semiconductor technology or a derivative other technology, it is naturally also possible to carry out function block integration using this technology. Application of biotechnology is also possible.

The disclosures of Japanese Patent Application No. 2007-266922, filed on Oct. 12, 2007, and Japanese Patent Application No. 2007-285602, filed on Nov. 1, 2007, including the specifications, drawings and abstracts, are included herein by reference in their entireties.

Industrial Applicability

The vector quantization apparatus, vector dequantization apparatus and vector quantization and dequantization methods according to the present invention are applicable to such uses as speech coding and speech decoding.

The invention claimed is:

1. A vector quantization apparatus comprising:

a classifier, included in a processor, that generates classification information indicating a type of a feature that includes a voice characteristic and is correlated with a quantization target vector among a plurality of types;

a selector, included in a processor, that selects one first codebook according to the classification information, the selected first codebook being associated with the classification information and including a plurality of first code vectors, from a plurality of first codebooks associated with the plurality of types, respectively;

a first quantizer, included in a processor, that acquires a first code by quantizing the quantization target vector using the plurality of first code vectors included in the selected first codebook;

a scaling factor codebook comprising scaling factors associated with the plurality of types, respectively; and a second quantizer, included in a processor, that has a second codebook comprising a plurality of second code vectors and acquires a second code by quantizing a residual vector between one first code vector indicated by the first code and the quantization target vector, using the second code vectors and a scaling factor associated with the classification information.

2. The vector quantization apparatus according to claim 1, further comprising a multiplier, included in a processor, that acquires a multiplication vector by multiplying the residual vector by a reciprocal of the scaling factor associated with the classification information, wherein the second quantizer quantizes the multiplication vector using the plurality of second code vectors.

3. The vector quantization apparatus according to claim 1, further comprising a multiplier, included in a processor, that acquires a plurality of multiplication vectors by multiplying each of the plurality of second code vectors by the scaling factor associated with the classification information, wherein the second quantizer quantizes the residual vector using the plurality of multiplication vectors.

4. The vector quantization apparatus according to claim 1, further comprising a third quantizer, included in a processor, that has a third codebook comprising a plurality of third code vectors and acquires a third code by quantizing a second residual vector between one second code vector indicated by the second code and the residual vector, using the third code vectors and the scaling factor associated with the classification information.

5. The vector quantization apparatus according to claim 4, further comprising a second multiplier, included in a processor, that acquires a second multiplication vector by multiplying the second residual vector by a reciprocal of the scaling factor associated with the classification information, wherein the third quantizer quantizes the second multiplication vector using the plurality of third code vectors.

6. The vector quantization apparatus according to claim 4, further comprising a second multiplier, included in a processor, that acquires a plurality of second multiplication vectors by multiplying each of the plurality of third code vectors by the scaling factor associated with the classification information, wherein the third quantizer quantizes the second residual vector using the plurality of second multiplication vectors.

7. The vector quantization apparatus according to claim 1, wherein the first quantizer calculates differences between the quantization target vector and the plurality of first code vectors included in the selected first codebook, and acquires the first code by selecting a residual vector which has a minimum difference of the calculated differences.

8. The vector quantization apparatus according to claim 1, wherein the scaling factor codebook is configured to output the scaling factor associated with the classification information.

9. The vector quantization apparatus according to claim 1, wherein the classifier stores a classification codebook including a plurality of code vectors associated with a plurality of types of narrowband LSP vectors, and selects classification information indicating a type of a wideband LSP vector of the vector quantization target from the classification codebook.

10. A vector dequantization apparatus comprising:

a classifier, included in a processor, that generates classification information indicating a type of a feature that includes a voice characteristic and is correlated with a quantization target vector among a plurality of types;

a demultiplexer, included in a processor, that demultiplexes a first code that is a quantization result of the quantization target vector in a first stage and a second code that is a quantization result of the quantization target vector in a second stage, from received encoded data;

a selector, included in a processor, that selects one first codebook according to the classification information, the selected first codebook being associated with the classification information and including a plurality of first code vectors, from a plurality of first codebooks associated with the plurality of types, respectively;

a first dequantizer, included in a processor, that selects one first code vector associated with the first code from the selected first codebook;

a scaling factor codebook comprising scaling factors associated with the plurality of types, respectively; and a second dequantizer, included in a processor, that selects one second code vector associated with the second code from a second codebook comprising a plurality of second code vectors, and acquires the quantization target vector using the one second code vector, a scaling factor associated with the classification information and the one first code vector.

11. A vector quantization method comprising:

generating classification information indicating a type of a feature that includes a voice characteristic and is correlated with a quantization target vector among a plurality of types;

selecting one first codebook according to the classification information, the selected first codebook being associated with the classification information and including a plurality of first code vectors, from a plurality of first codebooks associated with the plurality of types, respectively;

acquiring a first code by quantizing the quantization target vector using a plurality of first code vectors forming the selected first codebook; and acquiring a second code by quantizing a residual vector between a first code vector associated with the first code and the quantization target vector, using a plurality of second code vectors forming a second codebook and a scaling factor associated with the classification information.

12. A vector dequantization method comprising:

generating classification information indicating a type of a feature that includes a voice characteristic and is correlated with a quantization target vector among a plurality of types;

demultiplexing a first code that is a quantization result of the quantization target vector in a first stage and a second code that is a quantization result of the quantization target vector in a second stage, from received encoded data;

selecting one first codebook according to the classification information, the selected first codebook being associated with the classification information and including a plurality of first code vectors, from a plurality of first codebooks associated with the plurality of types, respectively;

selecting one first code vector associated with the first code from the selected first codebook; and selecting one second code vector associated with the second code from a second codebook comprising a plurality of second code vectors, and generating the quantization target vector using the one second code vector, a scaling factor associated with the classification information and the one first code vector.

* * * * *